US011617463B2

(12) United States Patent
Gu

(10) Patent No.: US 11,617,463 B2
(45) Date of Patent: Apr. 4, 2023

(54) SHOE RACK FOR EXERCISE BIKE

(71) Applicant: Haidong Gu, Pomona, CA (US)

(72) Inventor: Haidong Gu, Pomona, CA (US)

(73) Assignee: CYCLINGDEAL USA, INC., Pomona, CA (US)

( * ) Notice: Subject to any disclaimer, the term of this patent is extended or adjusted under 35 U.S.C. 154(b) by 0 days.

(21) Appl. No.: 17/405,008

(22) Filed: Aug. 17, 2021

(65) Prior Publication Data

US 2023/0058306 A1 Feb. 23, 2023

(51) Int. Cl.
*A47G 25/00* (2006.01)
*A47F 5/01* (2006.01)
*A47F 7/08* (2006.01)

(52) U.S. Cl.
CPC ..... *A47G 25/005* (2013.01); *A47F 5/01* (2013.01); *A47F 7/08* (2013.01)

(58) Field of Classification Search
CPC . A47G 25/005; A47F 7/08; A47F 5/00; A47F 5/01; A47F 5/0006; A47F 5/04; A47F 7/00; A47L 23/20
USPC ..... 211/34
See application file for complete search history.

(56) References Cited

U.S. PATENT DOCUMENTS 2,710,051 A * 6/1955 Greenberg ..... A47C 7/70 297/170
2,902,167 A * 9/1959 Smith ..... A47F 7/08 248/302
5,127,529 A * 7/1992 Martinez ..... A47G 25/00 211/37
D367,382 S * 2/1996 Tseng ..... D6/678.4
5,566,838 A * 10/1996 Tseng ..... A47L 23/205 34/239
5,590,607 A * 1/1997 Howard ..... A47B 21/0314 248/231.71
D398,483 S * 9/1998 Stocco ..... D7/601
6,189,847 B1 * 2/2001 Hart ..... B25H 3/04 248/220.31
6,483,026 B1 * 11/2002 Snider, Jr. ..... H02G 3/32 174/496
D468,163 S * 1/2003 Blake ..... D7/601
D476,847 S * 7/2003 Kingsley ..... D7/396.1
2003/0213759 A1 * 11/2003 Compagnucci ..... A47L 19/04 211/41.11
2004/0251222 A1 * 12/2004 Ohanian ..... A47J 47/16 211/181.1
2006/0186124 A1 * 8/2006 Sergianni ..... A47J 47/16 220/572
2013/0284863 A1 * 10/2013 Daniel ..... F16M 11/24 248/125.1

(Continued)

*Primary Examiner* — Devin K Barnett

(57) ABSTRACT

A shoe rack for an exercise bike includes a shoe rack body and a connection holder. The shoe rack body includes a first shoe placing portion and a second shoe placing portion, the connection holder is connected to the shoe rack body, the connection holder can be disposed on a base member of an exercise bike, and the first shoe placing portion and the second shoe placing portion can be used to place shoes. Therefore, when the exercise bike is mounted with the shoe rack, a rider can place the shoes, required for riding the exercise bike, in the shoe rack body, so that the rider does not need to carry the shoes when planning to ride the exercise bike, and the conventional problem is effectively solved.

7 Claims, 14 Drawing Sheets

(56) References Cited

U.S. PATENT DOCUMENTS

| | | | | |
|---|---|---|---|---|
| 2015/0014495 | A1* | 1/2015 | Bausman | A47J 47/16<br>248/176.2 |
| 2019/0110637 | A1* | 4/2019 | Groll | A47J 36/12 |
| 2020/0397196 | A1* | 12/2020 | Nie | A47B 77/14 |

* cited by examiner

SHOE RACK FOR EXERCISE BIKE

BACKGROUND OF THE INVENTION

1. Field of the Invention

The present invention is related to a shoe rack which can be disposed on a base member of an exercise bike, so that a user can place shoes, required for riding the exercise bike, in the shoe rack.

2. Description of the Related Art

Exercise is a way to keep the body healthy; among the known exercises, riding an exercise bike is a very popular exercise.

Although the exercise bike is an indoor exercise equipment, shoes are still required when riding the exercise bike because wearing shoes can improve the efficiency of pedaling and prevent foot injuries. However, the rider generally does not wear the shoe indoors, or the rider generally wears special bicycle shoes when riding the exercise bike. Therefore, for most people, the shoe worn for riding an exercise bike is an extra preparation. Every time planning to ride the exercise bike, the rider needs to carry additional shoes required for riding the exercise bike, and it is quite inconvenient for the rider.

SUMMARY OF THE INVENTION

In order to solve the conventional problem, the present invention provides a show rack including a connection holder which can be disposed on a base member of an exercise bike, and the connection holder is connected to a shoe rack body, and the shoe rack body includes a first shoe placing portion and a second shoe placing portion, and the first shoe placing portion and the second shoe placing portion can be used to place shoes; therefore, when the exercise bike is mounted with the shoe rack, a rider can place the shoes, required for riding the exercise bike, in the shoe rack body, so that the rider does not need to carry the shoes when planning to ride the exercise bike, and the conventional problem is effectively solved.

In order to achieve the above-mentioned objective and effect, the present invention provides a shoe rack for exercise bike, the shoe rack includes a shoe rack body and a connection holder. The shoe rack body includes a top portion, a first tapered section, a first connection section, a second tapered section and a second connection section. The top portion includes a first shoe placing portion and a second shoe placing portion upwardly protruded thereon and arranged in interval, the top portion includes a first imaginary line vertically passing through the center of the top portion, the first tapered section is connected to and bent from an end of the top portion, and downwardly extended and inclined gradually toward the first imaginary line, an extension end of the first tapered section is connected to the first connection section, the second tapered section is connected to and bent from other end of the top portion, the second tapered section is downwardly extended and inclined gradually toward the first imaginary line, and an extension end of the second tapered section is connected to the second connection section. The connection holder is connected to the first connection section and the second connection section.

According to an embodiment, the present invention further provides a shoe rack for an exercise bike, and the shoe rack includes a shoe rack body and a connection holder. The shoe rack body include a top portion, a first tapered section, a first connection section, a second tapered section and a second connection section. The top portion includes a first shoe placing portion and a second shoe placing portion upwardly protruded thereon and arranged in interval, the top portion includes a first imaginary line vertically passing through a center thereof, the first tapered section is connected to and bent from an end of the top portion, the first tapered section is downwardly extended and inclined gradually toward the first imaginary line, an extension end of the first tapered section is connected to the first connection section, the second tapered section is connected to and bent from other end of the top portion, the second tapered section is downwardly extended and inclined gradually toward the first imaginary line, and an extension end of the second tapered section is connected to the second connection section. The connection holder is connected to the first connection section and the second connection section, and includes a top curved part, a first buckle and a second buckle. The two ends of the top curved pan are in downwardly-bent shapes, a second imaginary line passes through the top curved part vertically, two ends of the top curved part are downwardly extended and bend toward the second imaginary line to form the first buckle and the second buckle, and a buckling space is formed by the top curved part, the first buckle, and the second buckle.

According to an embodiment, the present invention further provides a shoe rack for an exercise bike, and the shoe rack includes a shoe rack body, a connection holder and the enclosing device. The shoe rack body includes a top portion, a first tapered section, a first connection section, a second tapered section and a second connection section, wherein the top portion comprises a first shoe placing portion and a second shoe placing portion upwardly protruded thereon and arranged in interval, a first imaginary line vertically passes through a center of the top portion, the first tapered section is connected to and bent from an end of the top portion, the first tapered section is downwardly extended and inclined gradually toward the first imaginary line, an extension end of the first tapered section is connected to the first connection section, the second tapered section is connected to and bent from other end of the top portion, the second tapered section is downwardly extended and inclined gradually toward the first imaginary line, and an extension end of the second tapered section is connected to the second connection section. The connection holder includes two straight-rod sections, and a curved strip section connected between ends of the two straight-rod sections. An opening is formed between the ends, not connected to the curved strip section, of the two straight-rod sections, and a side, away from the opening, of the curved strip section is at least connected to one of the first connection section and the second connection section. The enclosing device is movably disposed on the ends, forming the opening, of the two straight-rod sections and configured to enclose or open the opening.

BRIEF DESCRIPTION OF THE DRAWINGS

The structure, operating principle and effects of the present invention will be described in detail by way of various embodiments which are illustrated in the accompanying drawings.

DETAILED DESCRIPTION OF THE PREFERRED EMBODIMENTS

Figure 1:
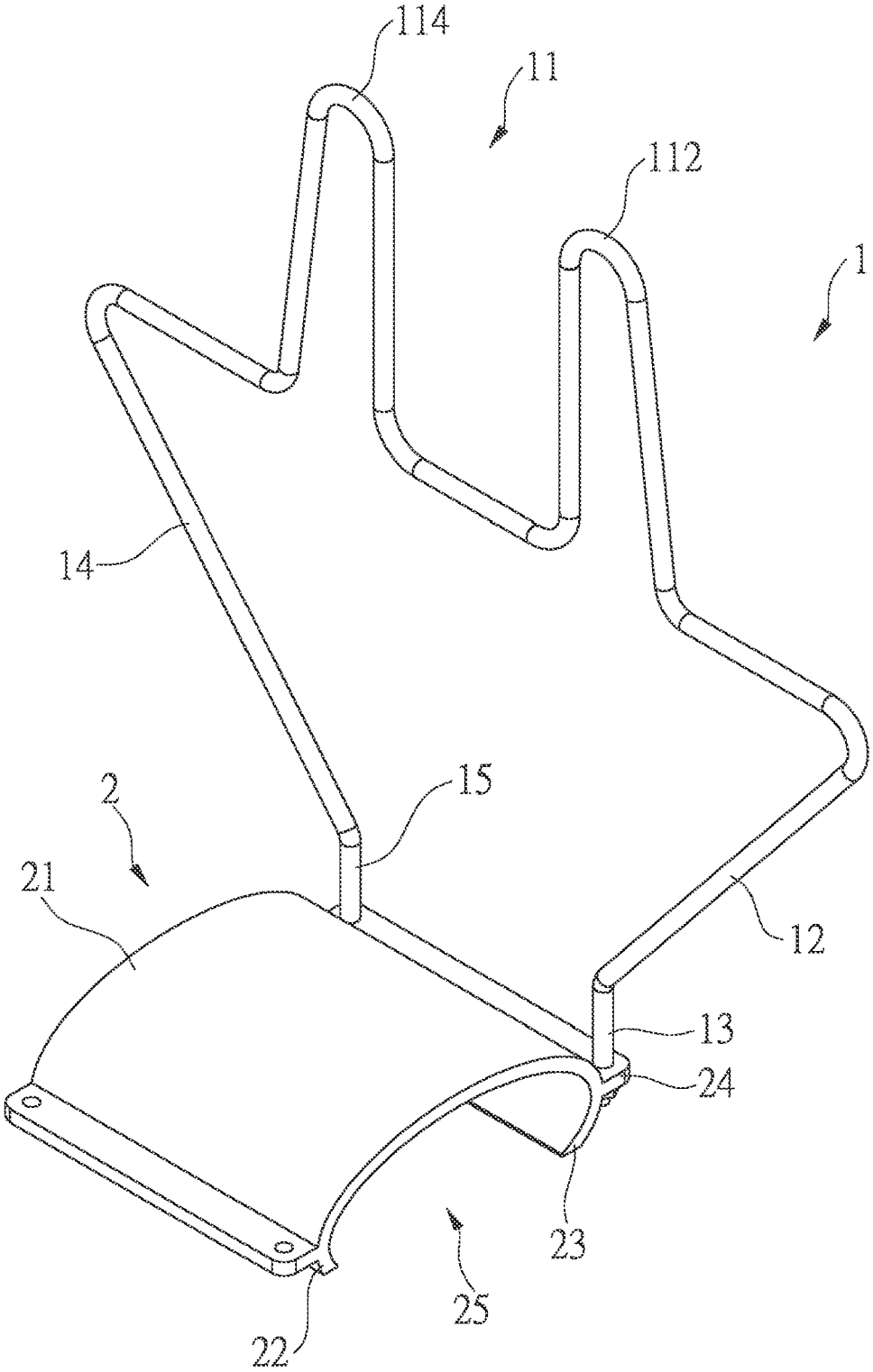
FIG. 1 is a perspective view of a shoe rack of the present invention.
Figure 2:
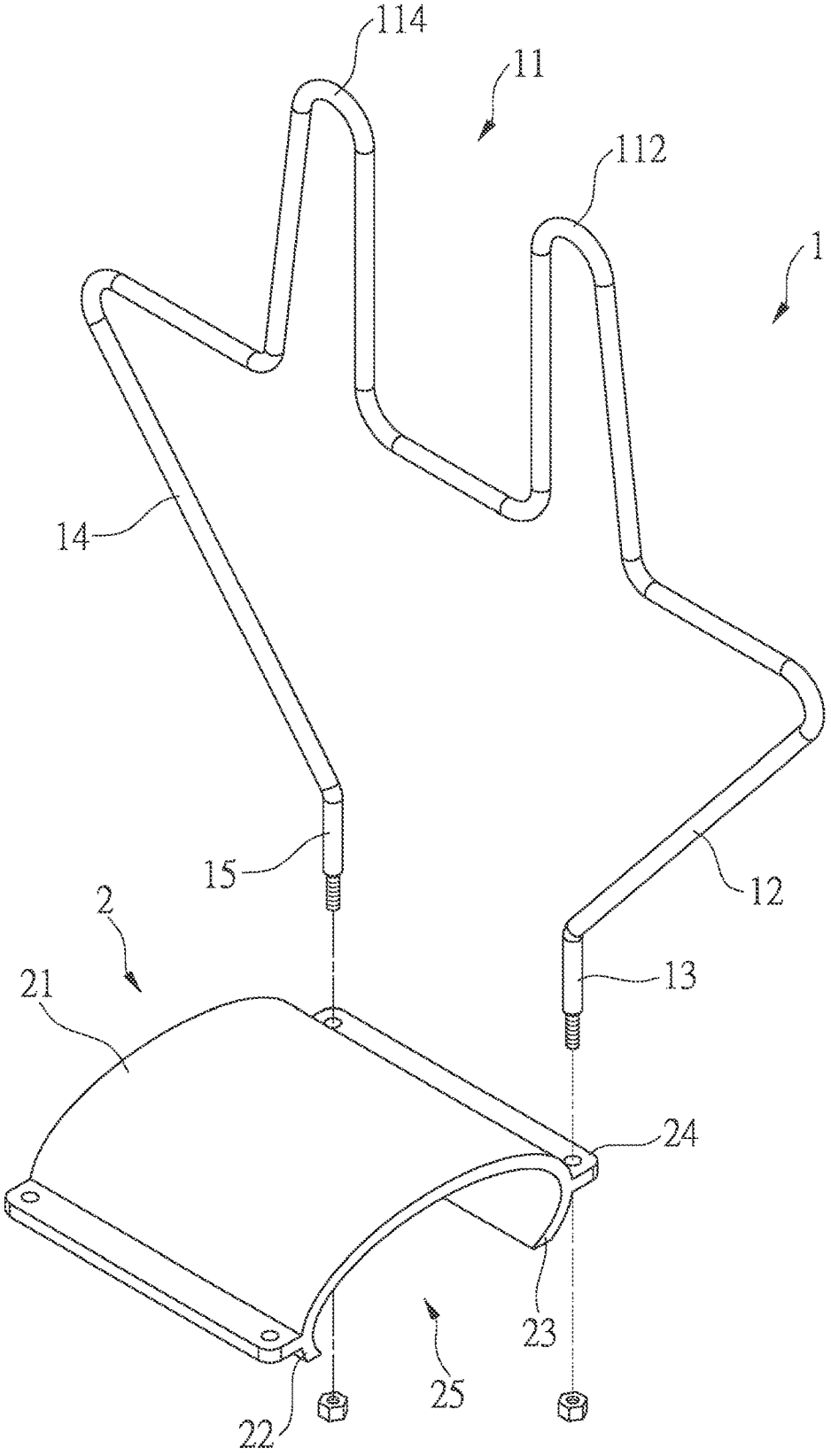
FIG. 2 is an exploded view of a shoe rack of the present invention.

The following embodiments of the present invention are herein described in detail with reference to the accompanying drawings. These drawings show specific examples of the embodiments of the present invention. These embodiments are provided so that this disclosure will be thorough and complete, and will fully convey the scope of the invention to those skilled in the art. It is to be acknowledged that these embodiments are exemplary implementations and are not to be construed as limiting the scope of the present invention in any way. Further modifications to the disclosed embodiments, as well as other embodiments, are also included within the scope of the appended claims.

These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts. As used herein, the singular forms "a", "an" and "the" are intended to include the plural forms as well, unless the context clearly indicates otherwise.

It is to be acknowledged that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or more of the associated listed items.

It will be acknowledged that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present.

In addition, unless explicitly described to the contrary, the words "comprise" and "include", and variations such as "comprises", "comprising", "includes", or "including", will be acknowledged to imply the inclusion of stated elements but not the exclusion of any other elements.

The implementation of the present invention will be illustrated in detail with reference to FIGS. 1 to 14, As shown in FIG. 1, a shoe rack for an exercise bike includes a shoe rack body 1 and a connection holder 2. The shoe rack body 1 includes a top portion 11, a first tapered section 12, a first connection section 13, a second tapered section 14 and a second connection section 15. The top portion 11 includes a first shoe placing portion 112 and a second shoe placing portion 114 upwardly protruded thereon and arranged in interval, and a first imaginary line L1 vertically passes through a center of the top portion 11. The first tapered section 12 is connected to and bent from an end of the top portion 11, the first tapered section 12 is downwardly extended and inclined gradually toward the first imaginary line L1, an extension end of the first tapered section 12 is connected to the first connection section 13, the second tapered section 14 is connected to and bent from other end of the top portion 11, the second tapered section 14 is downwardly extended and inclined gradually toward the first imaginary line L1, an extension end of the second tapered section 14 is connected to the second connection section 15. The connection holder 2 is connected to the first connection section 13 and second connection section 15.

Figure 14:
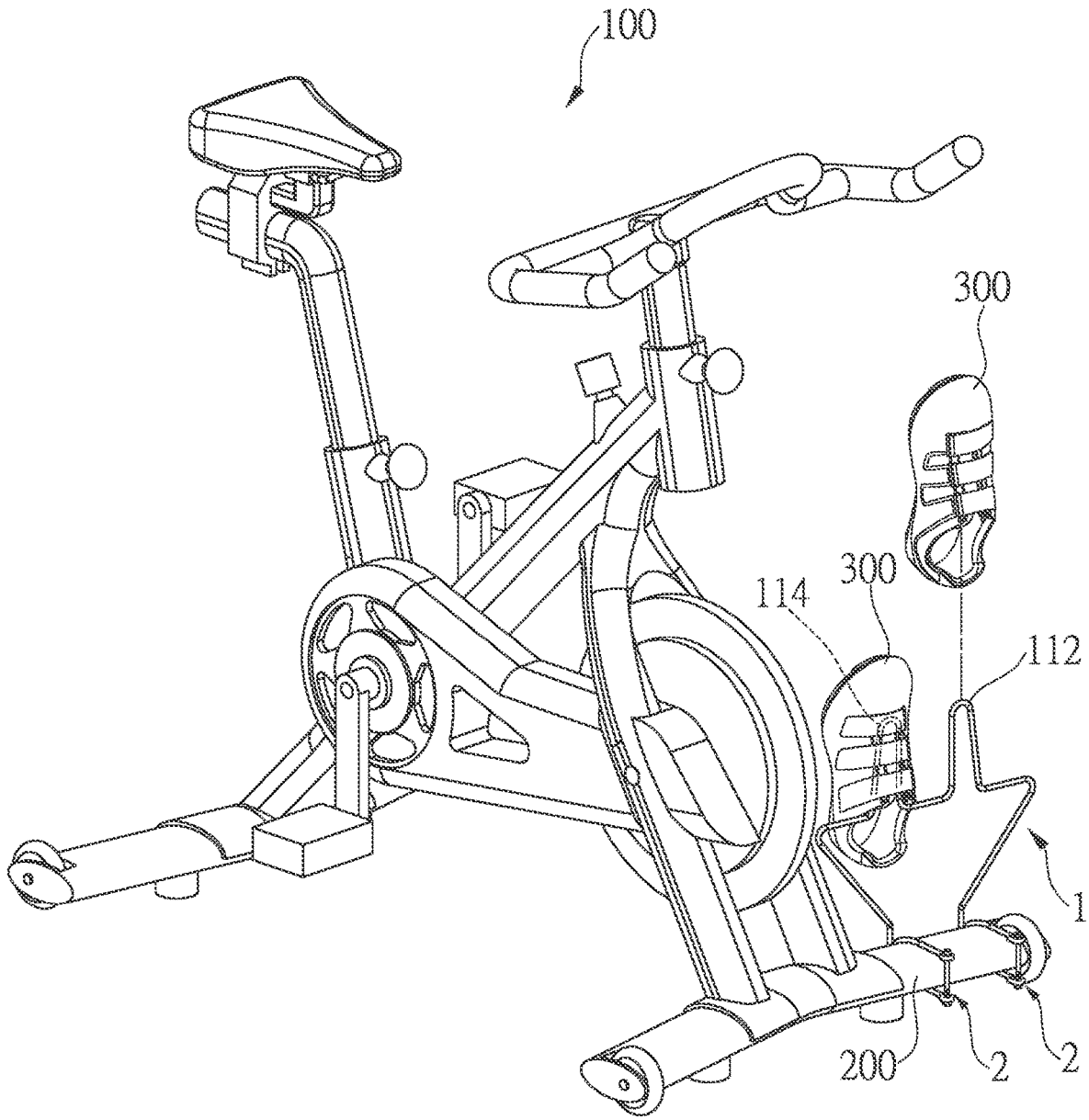
FIG. 14 is a schematic view of actual application of another embodiment of a connection holder, according to the present invention.

Following the above description, the implementation of the present invention is further recited in the following paragraphs. As shown in FIGS. 5, 6, 7 and 13, the connection holder 2 of the present invention can be connected to a base member 200 of the exercise bike 100, and as shown in FIGS. 7 and 14, the first shoe placing portion 112 and the second shoe placing portion 114 of the shoe rack body 1 can be used to hang and place shoes 300.

According to the above-mentioned contents, the shoe rack of the present invention allows the user to place the shoes 300, required for riding the exercise bike, in the shoe rack body 1, so that the user does not need to carry the shoes when planning to ride the exercise bike. As a result, the present invention indeed solves the conventional problem and has novelty and non-obviousness.

Figure 4:
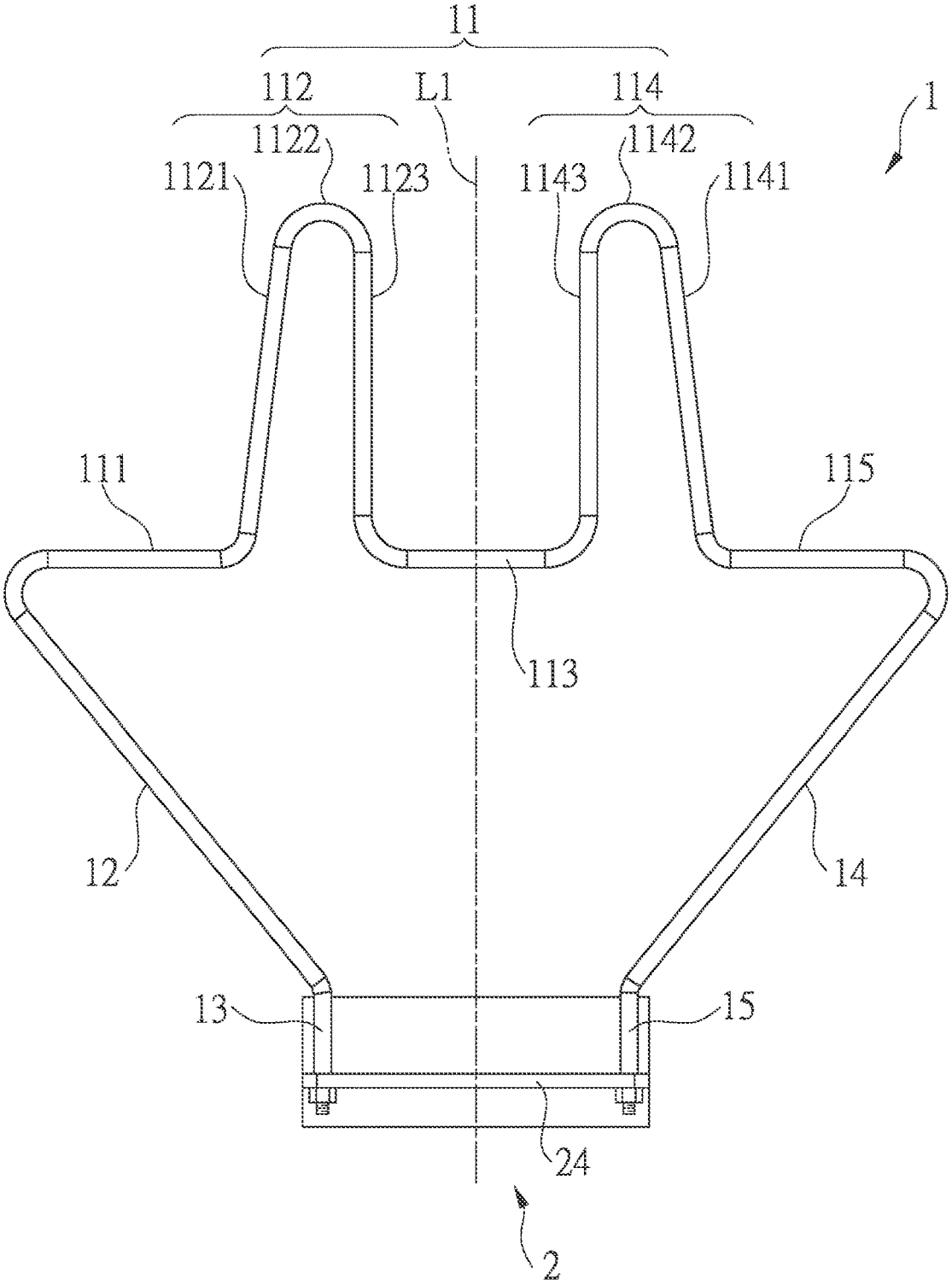
FIG. 4 is a schematic plan view of a shoe tack of the present invention, when viewed from another angle.
Figure 12:
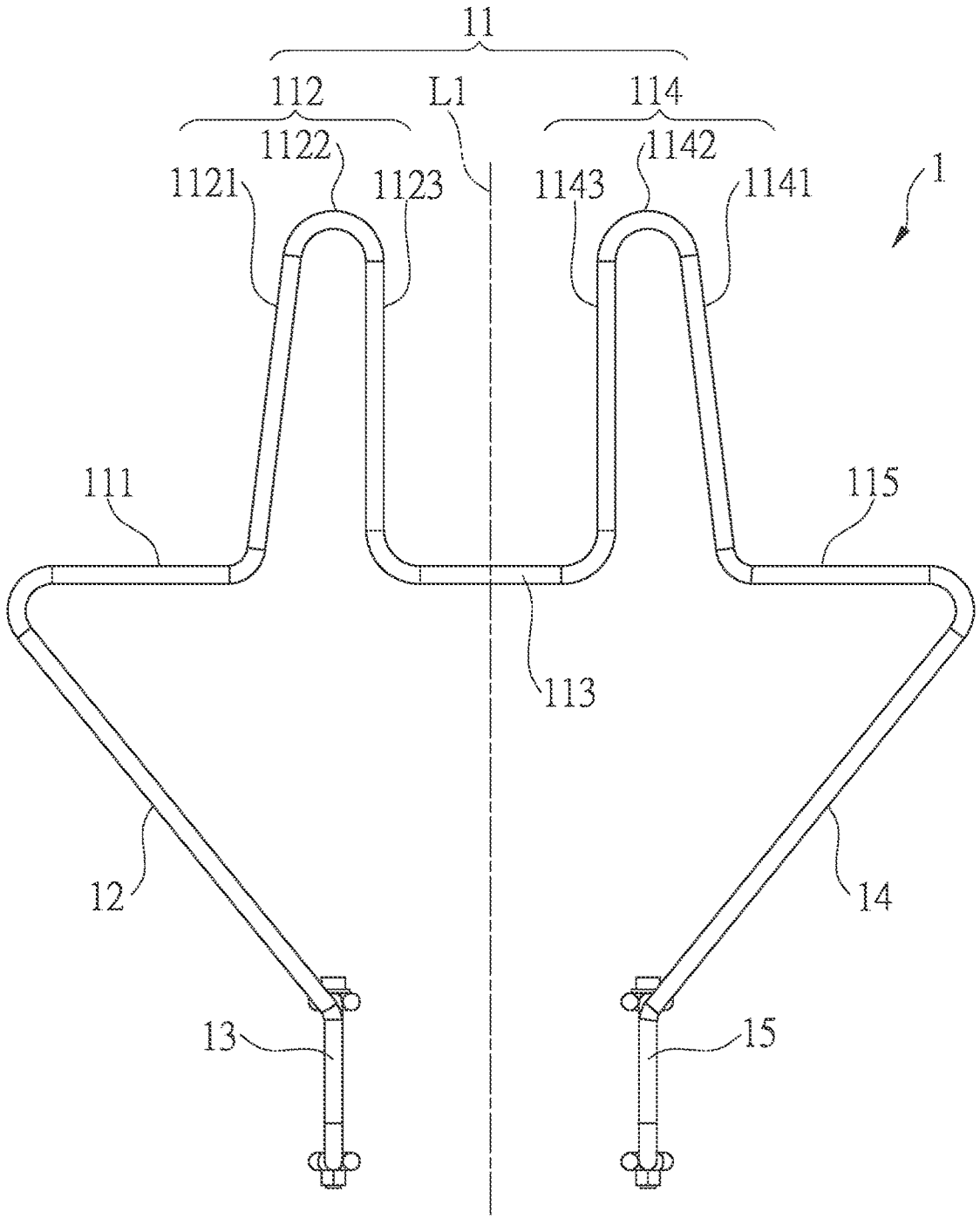
FIG. 12 is a schematic plan view of another embodiment of a connection holder, when viewed from another angle, according to the present invention.
Figure 13:
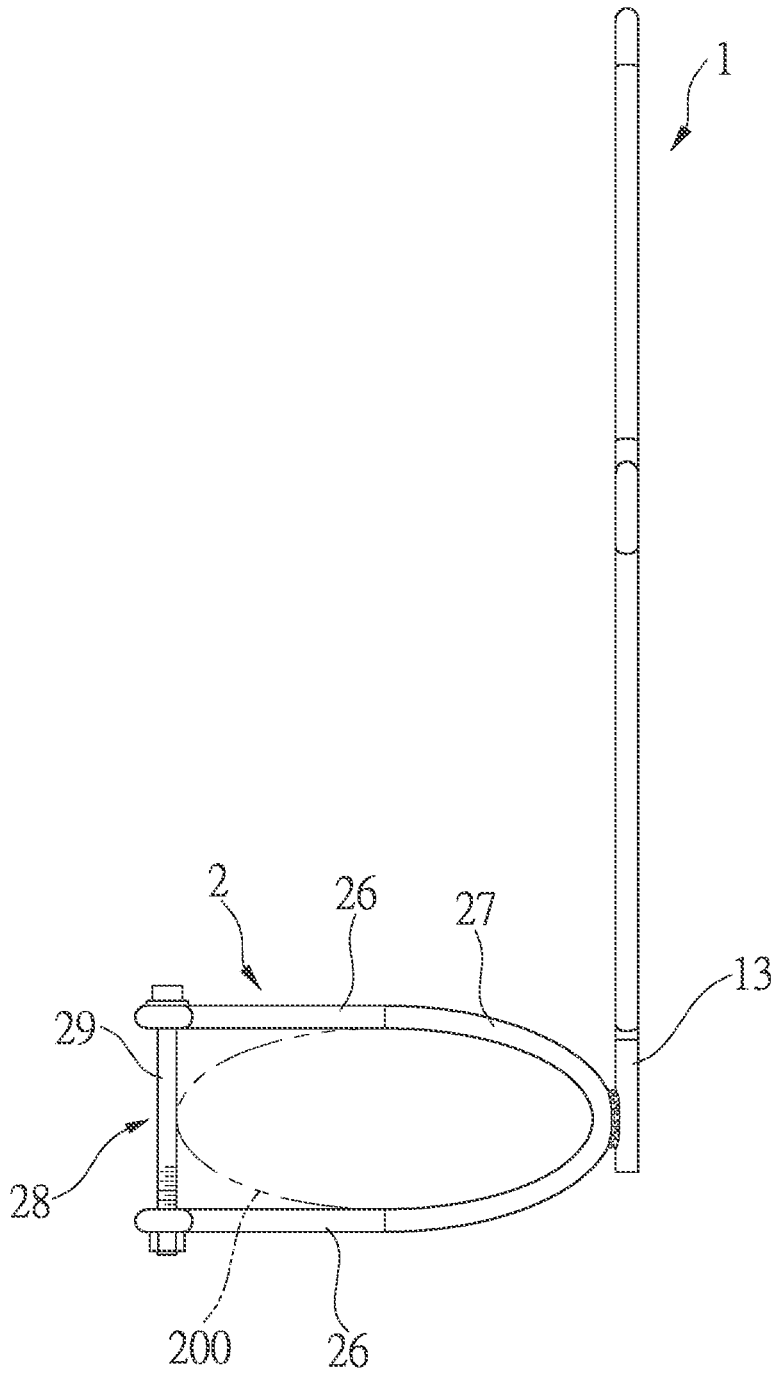
FIG. 13 is a schematic view of another embodiment of a connection holder buckled on a base member of an exercise bike, according to the present invention.

As shown in FIGS. 4 and 12, in the shoe rack body 1 of the present invention, the first tapered section 12, the second tapered section 14 and the top portion 11 form an inverted-triangle-like structure, so as to greatly improve intensity of overall architecture and improve stability of hanging the shoes 300 on the shoe rack body 1.

Furthermore, the connection holder 2 of the present invention can be implemented by two embodiments. FIGS. 1 to 8 show the first embodiment, the connection holder 2 is connected to the first connection section 13 and the second connection section 15, and the connection holder 2 includes a top curved part 21, two ends of the top curved part 21 are in downwardly-bent shapes, a second imaginary line L2 vertically passes through the top curved part 21, the two ends of the top curved part 21 are downwardly extended and bend toward the second imaginary line L2 to form a first buckle 22 and a second buckle 23. The top curved part 21, the first buckle 22, and the second buckle 23 form a buckling space 25. The connection holder 2 shown in FIGS. 5 and 6 can be quickly buckled on the base member 200 of the exercise bike 100, so as to achieve the quickly-mounting effect. The first connection section 13 and the second connection section 15 of this embodiment are fixed to the connection holder 2 by nuts.

Figure 3:
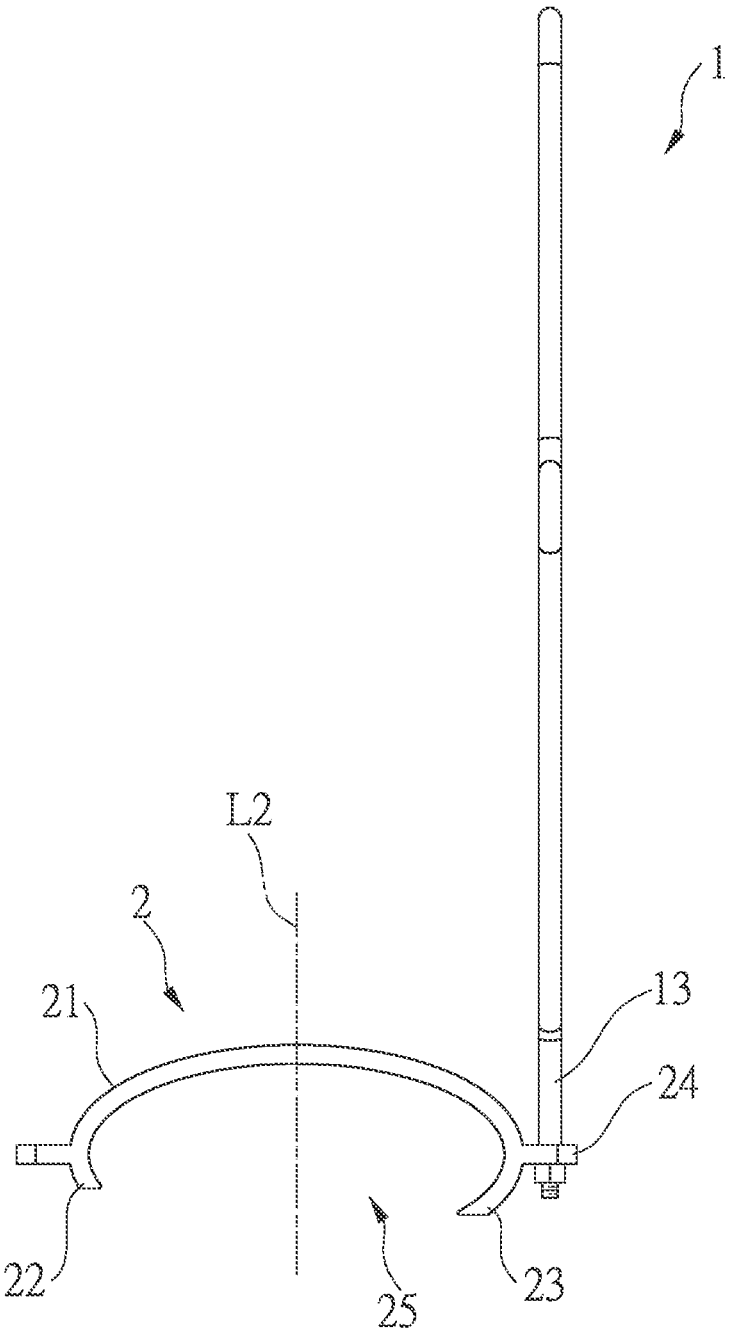
FIG. 3 is a schematic plan view of a shoe rack of the present invention.

As shown in FIGS. 3 and 4, the connection plate 24 is laterally extended from the top curved part 21, the connection holder 2 is connected to the first connection section 13 and the second connection section 15 via the connection plate 24, the connection plate 24 is in a flat shape which can be stably connected to the first connection section 13 and the second connection section 15 easily, compared with the curved shapes of the top curved part 21, the first buckle 22 and the second buckle 23. Furthermore, the first embodiment can include multiple connection plates 24, so that the shoe rack body 1 can be mounted on the connection holder 2 via the multiple connection plates 24.

Figure 5:
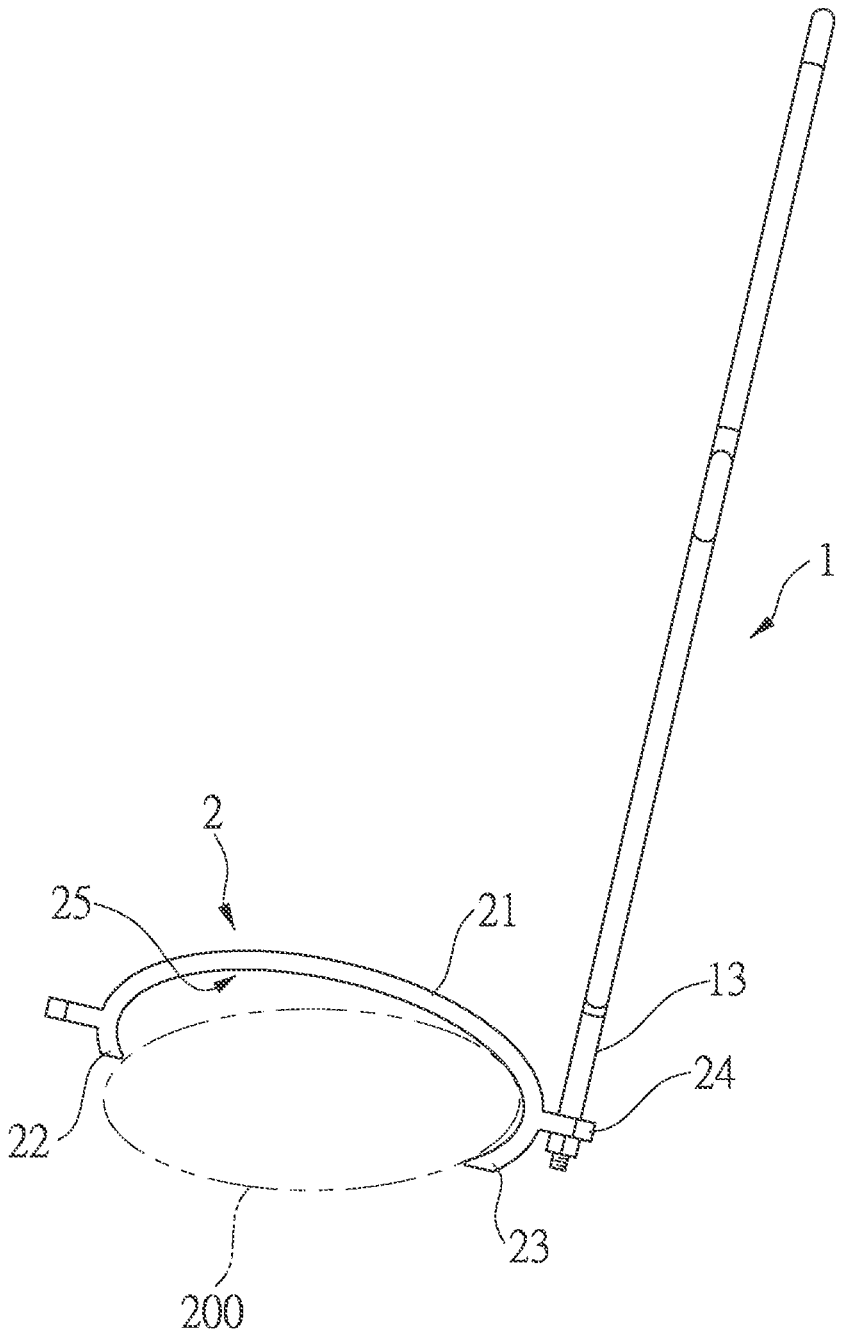
FIG. 5 is a first schematic view of a connection holder buckled on a base member of an exercise bike, according to the present invention.
Figure 6:
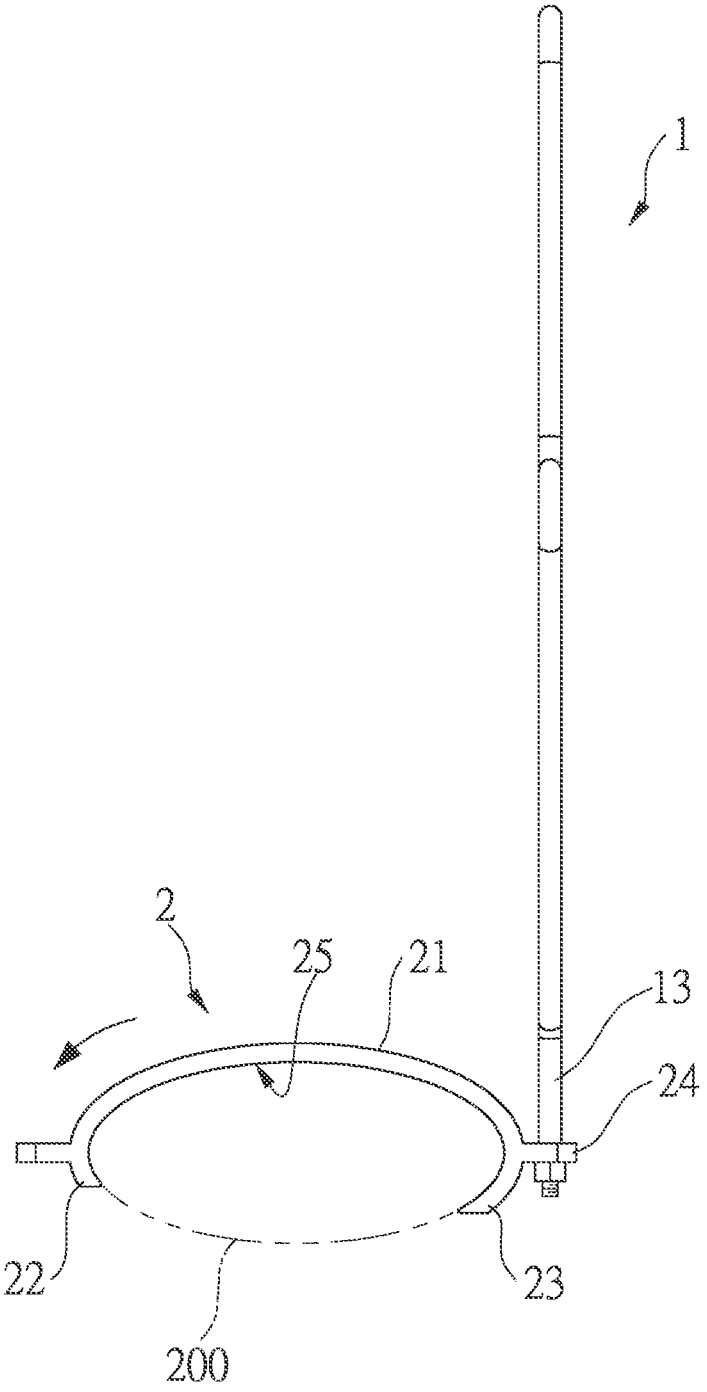
FIG. 6 is a second schematic view of the connection holder buckled on the base member of the exercise bike, according to the present invention.
Figure 7:
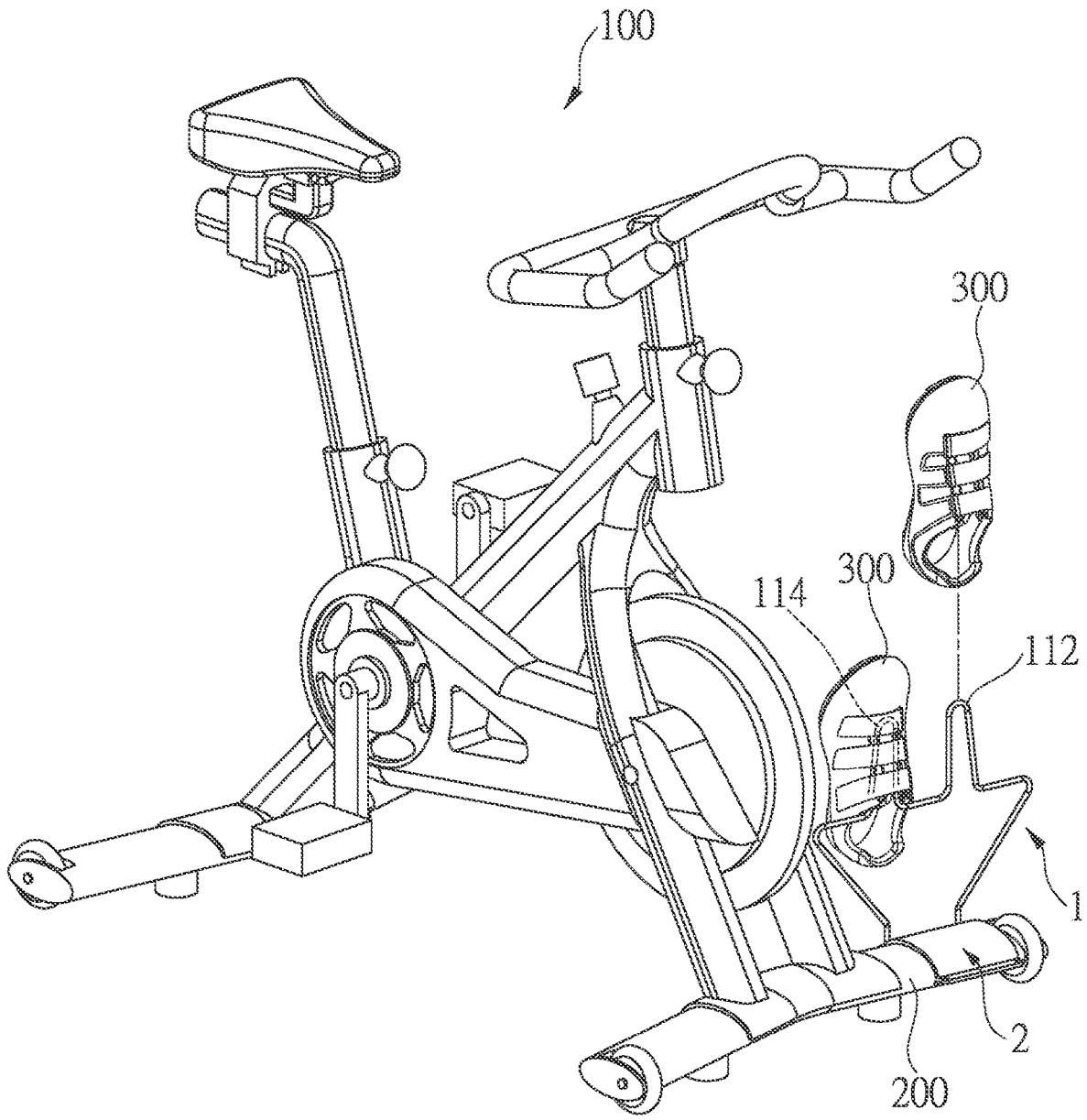
FIG. 7 is a schematic view of an actual application of the present invention.
Figure 8:
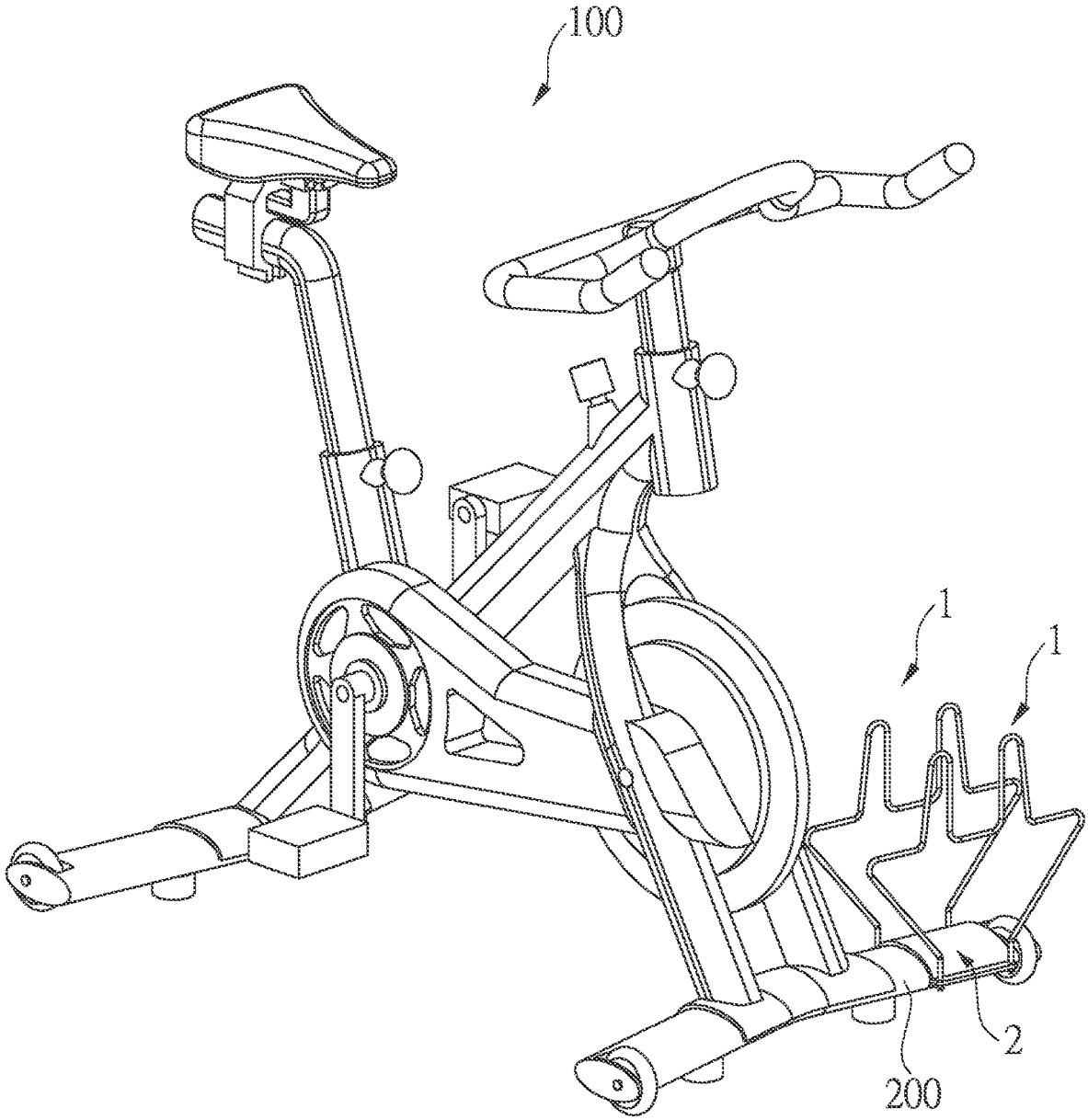
FIG. 8 is a schematic view of a shoe rack body mounted on a connection holder, according to the present invention.
Figure 9:
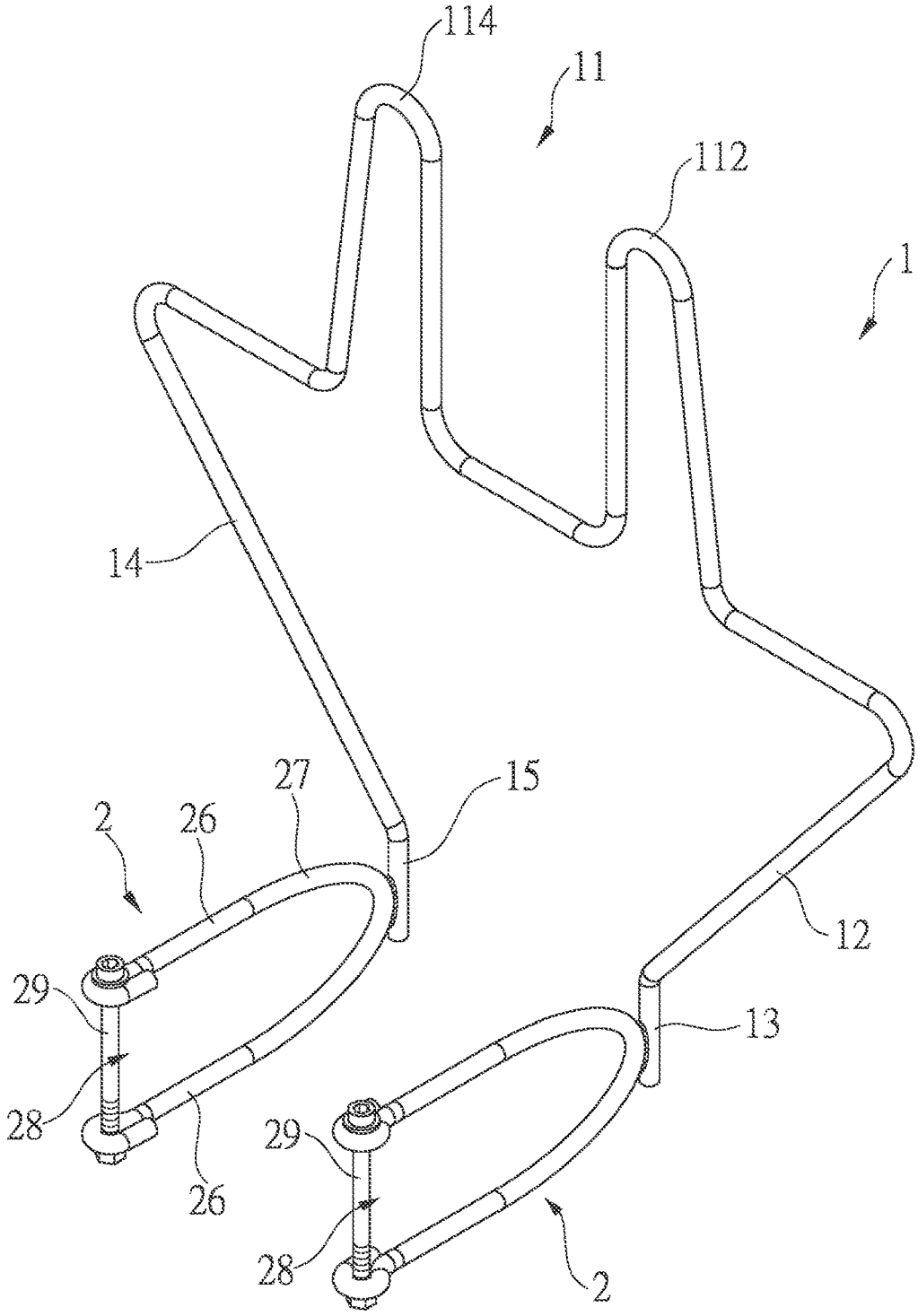
FIG. 9 is a perspective view of another embodiment of a connection holder, according to the present invention.
Figure 10:
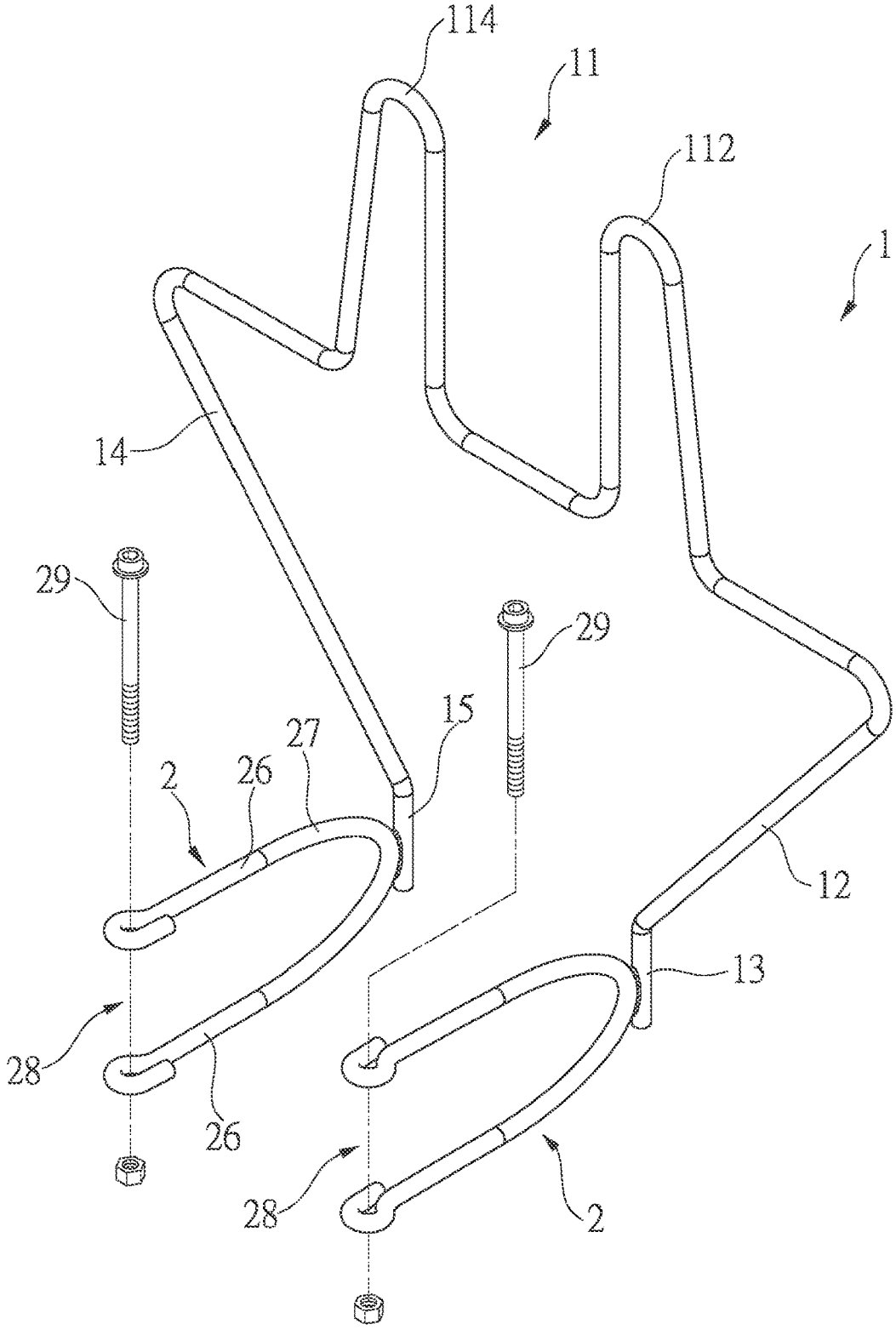
FIG. 10 is an exploded view of another embodiment of a connection holder, according to the present invention.
Figure 11:
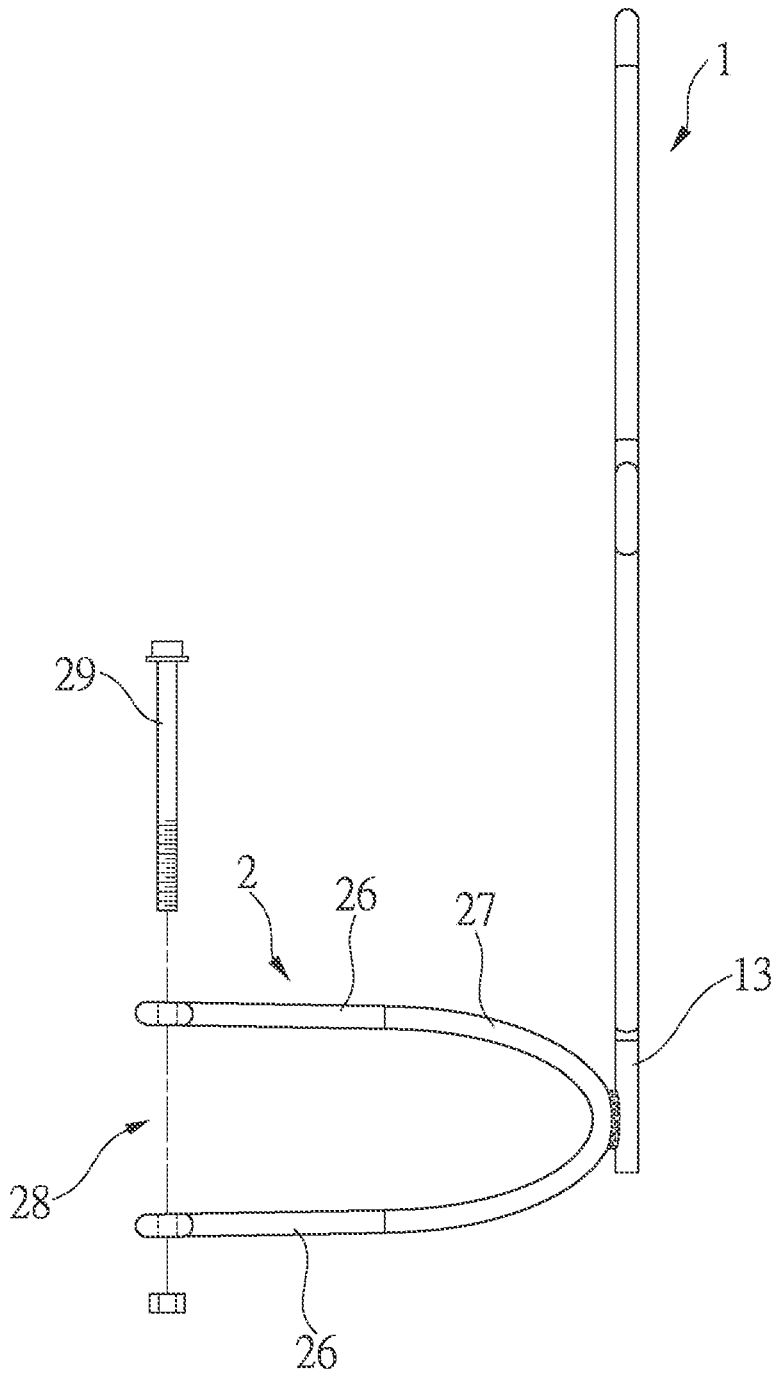
FIG. 11 is a schematic plan view of another embodiment of a connection holder, according to the present invention.

As shown in FIG. 3, an extension length of the second buckle 23 is greater than that of the first buckle 22, and the structure has the advantage that the longer second buckle 23 can be buckled on the base member 200 of the exercise bike 100 in advance, as shown in FIG. 5, and the second buckle 23 having sufficient length can be prevented from slipping out of the base member 200 by the impact force caused when the first buckle 22 is pressed, as shown in FIG. 6. Furthermore, it is more labor saving to press down the first buckle 22 having shorter length.

FIGS. 9 to 14 show the second embodiment of the connection holder 2. The connection holder 2 includes two straight-rod sections 26, a curved strip section 27 connected between ends of the two straight-rod sections 26, and an opening 28 formed between the ends, not connected to the curved strip section 27, of the two straight-rod sections 26. A side, away from the opening 28, of the curved strip section 27 is at least connected to one of the first connection section 13 and the second connection section 15. The connection holder 2 includes an enclosing device 29 movably disposed on the two straight-rod sections 26 to form an end of the opening 28 and configured to enclose or open the opening 28. Screws are taken as example of the enclosing device 29 in this embodiment; furthermore, the amount of the connection holders 2 can be increased according to different requirements, for example, two connection holders 2 can be connected to the first connection section 13 and the second connection section 15. The connection holder 2 using the enclosing device 29 can be more stably connected on the base member 200 of the exercise bike 100.

Please refer to FIGS. 4 and 12, which show an embodiment of the top portion 11. The top portion 11 can include a first horizontal section 111, a first inclined section 1121, a first bending section 1122, a first upright section 1123, a second horizontal section 113, a second inclined section 1141, a second bending section 1142, a second upright section 1143 and a third horizontal section 115. An end of the first horizontal section 111 is bent to connect to the first tapered section 12, the first inclined section 1121 is connected to and bent from other end of the first horizontal section 111, the first inclined section 1121 is upwardly extended and gradually inclined in a direction toward the first imaginary line L1, an extension end of the first inclined section 1121 is connected to the first bending section 1122, the first bending section 1122 is downwardly bent, an extension end of the first bending section 1122 is connected to the first upright section 1123, the first upright section 1123 is downwardly extended and an extension end of the first upright section 1123 is bent and connected to the second horizontal section 113, an extension end of the second horizontal section 113 is bent and connected to the second upright section 1143, the second upright section 1143 is upwardly extended and extension end of the second upright section 1143 is connected to a second bending section 1142, the second bending section 1142 is downwardly bent, an extension end of the second bending section 1142 is connected to the second inclined section 1141, the second inclined section 1141 is downwardly extended and gradually inclined in a direction away from the first imaginary line L1, an extension end of the second inclined section 1141 is bent and connected to the third horizontal section 115, an extension end of the third horizontal section 115 is bent and connected to the second tapered section 14. The first shoe placing portion 112 is formed by the first inclined section 1121, the first bending section 1122 and the first upright section 1123, and the second shoe placing portion 114 is formed by the second inclined section 1141, the second bending section 1142 and the second upright section 1143. In a condition that the shoe rack body 1 of the present invention is formed integrally to maintain the maximum intensity of the shoe rack body 1, the above-mentioned structure can form the first shoe placing portion 112 and the second shoe placing portion 114 without breaking the inverted-triangle structure, which formed by the first tapered section 12, the second tapered section 14 and the top portion 11.

Furthermore, as shown in FIGS. 4 and 12, the bent joint between the top portion 11 and each of the first tapered section 12 and the second tapered section 14 can be in a shape of a curved guide corner, and an included angle between the top portion 11 and each of the first tapered section 12 and the second tapered section 14 can be in a range of 45 degrees to 55 degrees; preferably, the included angle is 51 degrees. Therefore, the structure can effectively improve the structural intensity of the shoe rack body 1.

The present invention disclosed herein has been described by means of specific embodiments. However, numerous modifications, variations and enhancements can be made thereto by those skilled in the art without departing from the spirit and scope of the disclosure set forth in the claims.

What is claimed is:

1. A shoe rack for in exercise bike, comprising:

a shoe rack body comprising a top portion, a first tapered section, a first connection section, a second tapered section and a second connection section, wherein the top portion comprises a first shoe placing portion and a second shoe placing portion upwardly protruded thereon and arranged in interval, the top portion comprises a first imaginary line vertically passing through a center of the top portion, the first tapered section is connected to and bent from an end of the top portion, and downwardly extended and inclined gradually toward the first imaginary line, an extension end of the first tapered section is connected to the first connection section, the second tapered section is connected to and bent from an other end of the top portion, the second tapered section is downwardly extended and inclined gradually toward the first imaginary line, and an extension end of the second tapered section is connected to the second connection section; and a connection holder connected to the first connection section and the second connection section;

wherein the too portion comprises a first horizontal section, a first inclined section, a first bending section, a first upright section, a second horizontal section, a second inclined section, a second bending section, a second upright section and a third horizontal section, an end of the first horizontal section is bent to connect to the first papered section, the first inclined section is connected to and bent from another end of the first horizontal section, the first inclined section is upwardly extended and gradually inclined in a direction toward the first imaginary line, an extension end of the first inclined section is connected to the first bending section, the first bending section is downwardly bent, the extension end of the first bending section is connected to the first upright section, the first upright section is downwardly extended and an extension end of the first upright section is bent and connected to the second horizontal section, an extension end of the second horizontal section is bent and connected to the second upright section, the second upright section is upwardly extended and an extension end of the second upright section is connected to the second bending section, the second bending section is downwardly bent, an extension end of the second bending section is connected to the second inclined section, the second inclined section is downwardly extended and gradually inclined in a direction away from the first imaginary line, an extension end of the second inclined section is bent and connected to the third horizontal section, an extension end of the third horizontal section is bent to connect to the second tapered section, the first shoe placing portion is formed by the first inclined section, the first bending section and the first upright section, and the second shoe placing portion is formed by the second inclined section, the second bending section and the second upright section.

2. The shoe rack for an exercise bike according to claim 1, wherein a bent joint between the top portion and each of the first tapered section and the second tapered section is in a shape of a curved guide corner, and an included angle between the top portion and each of the first tapered section and the second tapered section is in a range of 45 degrees to 55 degrees.

3. A shoe rack form exercise bike, comprising:

a shoe rack body comprising a top portion, a first tapered section, a first connection section, a second tapered section and a second connection section, wherein the top portion comprises a first shoe placing portion and a second shoe placing portion upwardly protruded thereon and arranged in interval, the top portion comprises a first imaginary line vertically passing through a center thereof, the first tapered section is connected to and bent from an end of the top portion, the first tapered section is downwardly extended and inclined gradually toward the first imaginary line, an extension end of the first tapered section is connected to the first connection section, the second tapered section is connected to and bent from an other end of the top portion, the second tapered section is downwardly extended and inclined gradually toward the first imaginary line, and an extension end of the second tapered section is connected to the second connection section; and a connection holder connected to the first connection section and the second connection section, and comprising a top curved pan, a first buckle and a second buckle, wherein the two ends of the top curved part are in downwardly-bent shapes, a second imaginary line passes through the top curved part vertically, two ends of the top curved part are downwardly extended and bend toward the second imaginary line to form the first buckle and the second buckle, and a buckling space is formed by the top curved part, the first buckle, and the second buckle.

4. The shoe rack for an exercise bike according to claim 3, wherein the connection holder comprises a connection plate laterally extended from the top curved part, and the connection holder is connected to the first connection section and the second connection section via the connection plate.

5. The shoe rack for aa exercise bike according to claim 3, wherein an extension length of the second buckle is greater than an extension length of the first buckle.

6. The shoe rack for ma exercise bike according to claim 3, wherein the top portion comprises a first horizontal section, a first inclined section, a first bending section, a first upright section, a second horizontal section, a second inclined section, a second bending section, a second upright section and a third horizontal section, and an end of the first horizontal section is bent to connect to the first tapered section, the first inclined section is connected to and bent from an other end of the first horizontal section, the first inclined section is upwardly extended and gradually inclined in a direction toward the first imaginary line, an extension end of the first inclined section is connected to the first bending section, the first bending section is downwardly bent, an extension end of the first bending section is connected to the first upright section, the first upright section is downwardly extended and an extension end of the first upright section is bent and connected to the second horizontal section, an extension end of the second horizontal section is bent and connected to the second upright section, the second upright section is upwardly extended and an extension end of the second upright section is connected to the second bending section, the second bending section is downwardly bent, an extension end of the second bending section is connected to the second inclined section, the second inclined section is downwardly extended and gradually inclined in a direction away from the first imaginary line, an extension end of the second inclined section is bent and connected to the third horizontal section, an extension end of the third horizontal section is bent and connected to the second tapered section, the first shoe placing portion is formed by the first inclined section, the first bending section and the first upright section, and the second shoe placing portion is formed by the second inclined section, the second bending section and the second upright section.

7. The shoe rack for exercise bike according to claim 3, wherein a bent joint between the top portion and each of the first tapered section and the second tapered section is in a shape of curved guide corner, and an included angle between the top portion and each of the first tapered section and the second tapered section is in a range of 45 degrees to 55 degrees.

* * * * *